United States Patent [19]

Campoli

[11] 4,444,113

[45] Apr. 24, 1984

[54] HIGH-PRESSURE SELF-SEALING OBTURATOR IN SABOT DISCARD PROJECTILE

[75] Inventor: Ralph F. Campoli, Mine Hill, N.J.

[73] Assignee: The United States of America as represented by the Secretary of the Army, Washington, D.C.

[21] Appl. No.: 251,633

[22] Filed: Apr. 6, 1981

[51] Int. Cl.[3] ..... F42B 13/16

[52] U.S. Cl. ..... 102/430; 102/521; 102/703

[58] Field of Search ..... 102/430, 444, 520–528, 102/532, 703

[56] References Cited

U.S. PATENT DOCUMENTS

| | | | |
|---|---|---|---|
| 3,143,074 | 8/1964 | Jasse | 102/525 |
| 3,738,279 | 6/1973 | Eyre et al. | 102/703 |
| 3,762,332 | 10/1973 | Witherspoon | 102/523 |
| 3,786,760 | 1/1974 | Feldmann | 102/527 |
| 3,834,314 | 9/1974 | Young | 102/703 |
| 3,981,246 | 9/1976 | Luther et al. | 102/521 |
| 4,187,783 | 2/1980 | Campoli et al. | 102/520 |

*Primary Examiner*—Harold J. Tudor

*Attorney, Agent, or Firm*—Robert P. Gibson; Anthony T. Lane; Max Yarmovsky

[57] ABSTRACT

A high-pressure self-sealing obturator positioned to fit on the rear of a sabot assembly in a discarding projectile assembly to prevent the obturator from backing off during initial impact of bore walls by the projectile assembly. The obturator includes an extension and a groove for snapping a case mouth into the extension. The outer surface of the obturator conforms with the bore of the gun. The extention of the obturator also includes a "V" groove which permits the separation of the extention with the case mouth during the initial low pressure which occurs early ignition. The self-sealing obturator provides efficient and improved obturation for a projectile when fired from a high pressure gun tube.

5 Claims, 6 Drawing Figures

HIGH-PRESSURE SELF-SEALING OBTURATOR IN SABOT DISCARD PROJECTILE

GOVERNMENTAL INTEREST

The invention described herein may be manufactured, used, and licensed by or for the Government for governmental purposes without the payment to me of any royalty thereon.

BACKGROUND OF THE INVENTION

The present invention relates to the field of art dealing with projectiles. More particularly, the present invention relates to an improved obturator which can provide satisfactory obturation for a projectile when fired from a high pressure gun tube.

A worn gun tube produces many variations in interior and exterior ballistic performance and makes the determination of performance parameters unreliable. High pressure tank gun tubes erode from repeated firings by the movement of high temperature gases and residue generated from burning propellant, by chemical action and by friction between the projectile and gun. More particularly, same condition in the tank gun tubes exists due to poor obturation of the propelling gases which produce severe erosion of the bore as they escape between obturator and the bore walls of the tube.

In order to solve said problem of poor obturation, the use of a vulcanized rubber obturator is known in prior art. It performs satisfactorily at the ambient pressure of 80,000 psi but produces severe erosion of the bore at 125° F. (100,000 psi) due to high velocity gases escaping between the obturator and the bore. This results in very low tube life which causes poor accuracy and possible metal parts failure.

The basic shortcomings in prior art methods and apparatus have related to an absence of improved and reliable ballistic results. Accordingly, the present invention is intended as a solution to said problem.

PRIOR ART STATEMENT

U.S. Pat. No. 4,187,783 (1980) issued to the applicant as a joint inventor is of interest and partially pertinent to the present application. The present invention may be distinguished from the aforementioned reference in that said reference does not disclose the use of high pressure self-sealing obturator assembled from the rear of the sabot means whigh might perform satisfactorily even at high pressure such as 100,000 psi and high temperatures such as 140° F. The self-sealing obturator of the present invention provides efficient obturation of the propellant gases from a condemned gun tube with improved round to round dispersion.

SUMMARY OF THE INVENTION

The present invention relates to sabot system for a kinetic energy projectile which can be discarded efficiently. The system incorporates high pressure self-sealing obturator which provides efficient obturation at high temperature and high pressure even in a worn gun tube without impairing the accuracy and ballistic performance. The obturator is positioned to fit on the rear of the sabot assembly in a discarding sabot projectile assembly to prevent the obturator from backing off during the initial impact against bore walls of the projectile assembly.

An object of the present invention is to provide a discarding sabot system for a kinetic energy subcaliber projectile which can efficiently absorb the propellant force while driving the subcaliber projectile out of a gun.

Another object of the present invention is to provide an obturator which can perform satisfactorily at high pressures and high temperatures.

Another object of the present invention is to provide improved usefulness to a worn gun tube which is considered as unserviceable.

Another object of the present invention is to provide efficient obturation of the propellant gases from a condemned tube with improved round to round dispersion.

A further object of the present invention is to provide high pressure self sealing obturation for any type of projectile being full caliber or sub-caliber.

For a better understanding of the present invention, together with other and further objects thereof, reference is made to the following description taken in connection with the accompanying drawings.

DETAILED DESCRIPTION OF THE INVENTION

Figure 1:
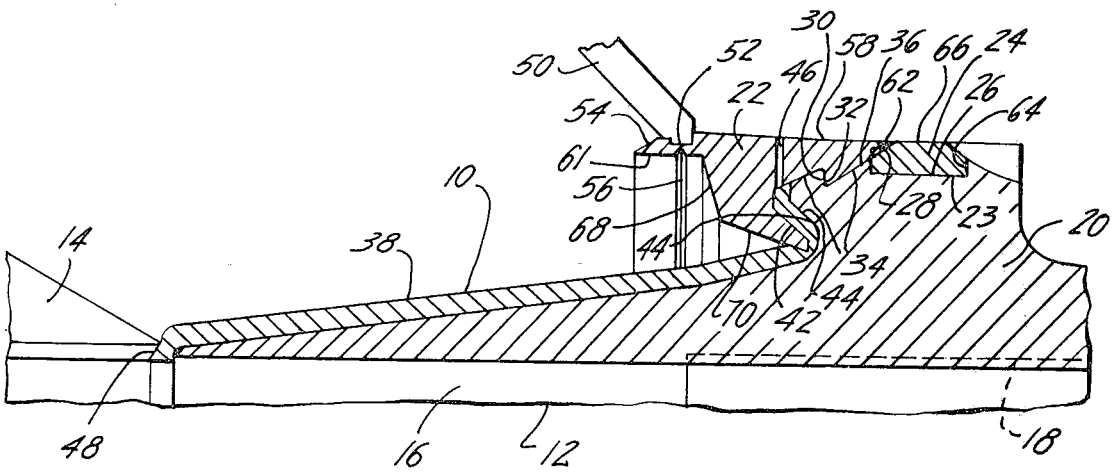
FIG. 1 is a partial cross-sectional view of a sabot discard projectile assembly with high pressure self-sealing obturator in position.
Figure 6:
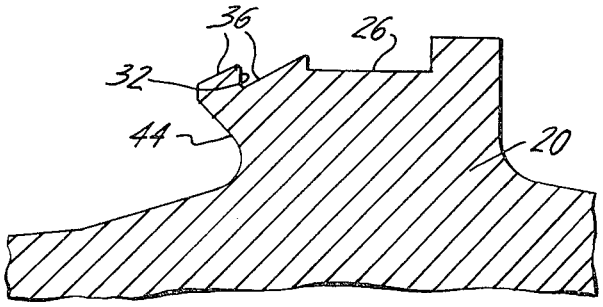
FIG. 6 is a partial cross-sectional view of sabot structure as shown in FIG. 1.

Referring now to FIGS. 1-6 the discarding sabot projectile assembly 10 comprises an arrow shaped subcaliber projectile 12, having a tail or fin 14 at end, a tubular shaped midsection 16, having a plurality of external concentric buttress grooves 18 disposed in the circumferential surface of the midsection 16 and a segmented sabot 20 as a full caliber carrier for the subcaliber projectile 12 and for obturating propellant gases during projectile launch. The sabot 20 incorporates high pressure self-sealing obturator 22 and a centering band 24. The centering band 24 is snapped into the centering band seat 26 with the tapered face 28 to the rear so that inside diametrical surface 23, shown in FIGS. 4 and 5, of the band 24 fixedly fits into the diametrical band seat 26. The self-sealing obturator 22 is snapped on the sabot 20 so that retaining lip 30 of the obturator 22 overlaps or makes close contact with retaining surface 32 of the sabot 20 shown in FIG. 6, which helps to prevent the self-sealing obturator 22 from backing off during the initial impact against bore walls, not shown. When retaining lip 30 and retaining surface 32 make close contact, the tapered surface 34 is also mated up with a matching surface 36 of sabot 20 as shown in FIG. 6. As shown in FIG. 1, the sabot assembly is covered with a rubber like sealing material cover 38. Cover 38 at its outer and inner surfaces makes intimate contact with surfaces, 42 (FIG. 1) and 44 (FIGS. 1 and 6) respectively. The cover 38 also extends from bleed holes 46 to fin hub 48 at the end of sabot 20. The mating case mouth 50 is snapped into a square groove 52 built into extension 54 of the obturator 22. The mating case mouth 50 is cemented to obturator 22 to reduce any movement of the obturator 22 and to act as a moisture barrier.

Figure 2:
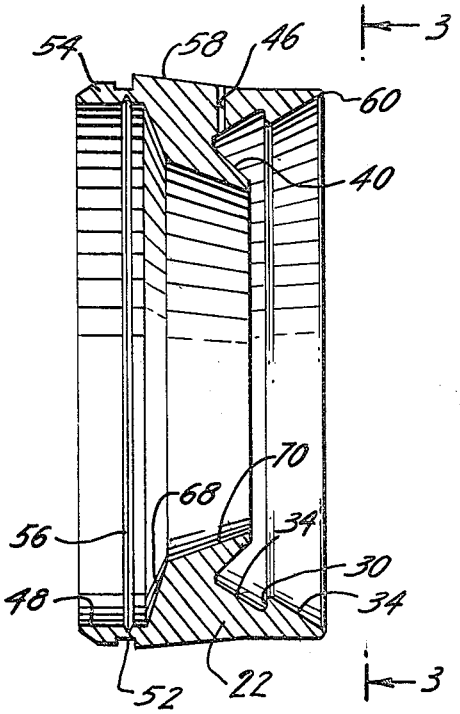
FIG. 2 is a diametrical cross-sectional view of the self sealing obturator as shown in FIG. 1.
Figure 3:
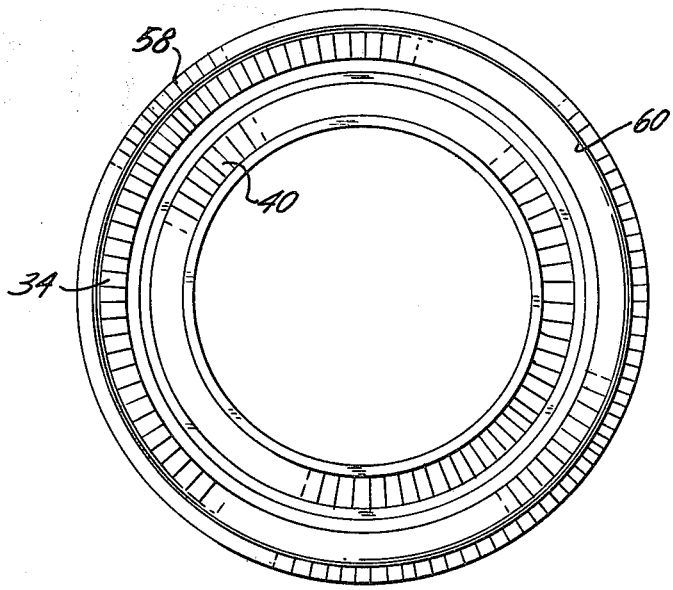
FIG. 3 is an end view of the self sealing obturator taken along line 3—3 of FIG. 2.
Figure 5:
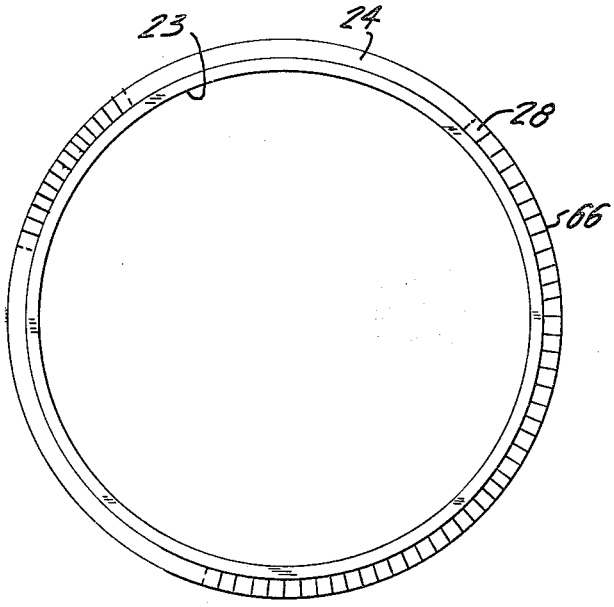
FIG. 5 is end view of the centering band taken along line 5—5 of FIG. 4.
Figure 4:
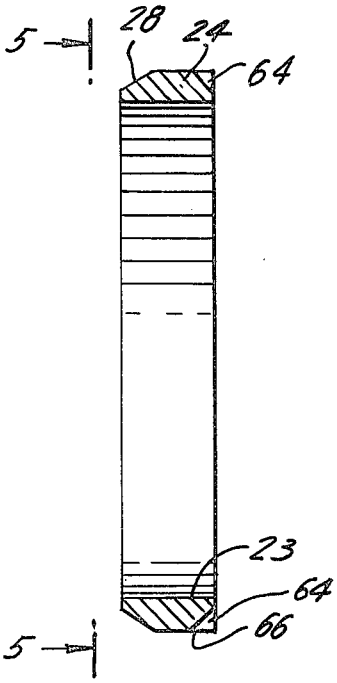
FIG. 4 is a diametrical cross-sectional view of the centering band as shown in FIG. 1.

As shown in FIGS. 1 and 2, the extension 54 further includes a "V" groove 56 which permits separation of the extension 54 from the case mouth 50 during the initial low pressure which occurs early in ignition. The outer surface 58 of the self-sealing obturator 22 is contoured to conform to the chamber walls of a gun, not shown. In order to assure that the centering band 24 discards after leaving the muzzle a stress notch 64 (FIGS. 1 and 6) is cut into the forward face of the centering band 24. At the junction 60, adjacent to tapered surface 28, a void exists which is filled with a rubber like material 62. This prevents propellant gases from entering and being trapped, in turn, also permits the obturator 22 to move forward as required for its efficient operation. The outer surface 66 of centering band 24 is slightly larger than the gun bore diameter and the forward face of the notch 64 is located close to the gun forcing cone.

In operation when a charge is ignited, the pressure begins building up and the self-sealing obturator 22 is subjected to the high pressure at the plurality of surfaces such at 61,68 and 70. During the build-up of the chamber pressures the surface 70 (FIG. 1) moves forward and provides a perfect seal between faces 40 (FIG. 2), 42 (FIG. 1) and 44 (FIGS. 1 and 6). The gas pressure applied to the face 68 forces the self-sealing obturator 22 up ramps (tapered surface) 34 producing an intimate contact between surface 58 of the obturator 22 and the gun bore. The rubber like material 62 is also forced against the bore walls. As the centering band 24 engages the gun forcing cone, not shown, the band 24 begins to extrude immediately preventing the initial low pressure gases from escaping. The centering band during extrusion centrally locates sabot projectile assembly 10 and maintains it in this position during down bore travel. Thus, projectile bore balloting is substantially reduced. After extrusion of the centering band 24, the self-sealing obturator 22 takes over providing an excellent means for resisting blow-by to the exceptionally high gas pressures presently found in new improved weapons. The efficient and highly improved seal is maintained for the full travel down-bore because the obturator 22 sealing material is continually fed between the projectile assembly 10 and the gun bore. This is achieved by the ramps 34 which provide the necessary material restrictions to choke off the gases. The sealing material 38 is primarily used to prevent gases from entering between the interfaces of the sabot segments. The base configuration of the self-sealing obturator also serves another purpose in that cup shape immediately traps the muzzle gas when exiting the muzzle, at which time the high velocity muzzle gases produce separation of the obturator 22 instantaneously. The gases producing instant separation are applied to faces 61, 68 and 70, permitting the sabot 20 to separate freely without interference to the sub-caliber projectile 12. The obturator 22 as described hereintofore is adaptable to a full caliber projectile of any type of base configuration.

Accordingly, while there have been shown and described the preferred embodiments of the present invention, it will be understood that the invention may be embodied or described otherwise than as herein specifically illustrated or described and that within said embodiments certain changes in the detail and construction, and form of arrangement of the parts may be made without departing from the underlying idea or principles of this invention within the scope of the appended claims.

What is claimed is:

1. A discarding sabot projectile assembly for a gun tube which comprises:

(a) sub-caliber projectile having a tail end and a tubularly shaped midsection, said midsection having a plurality of external concentric buttress grooves circumferentially disposed therein;

(b) segmented sabot assembly means surrounding said mid sections for use as a full caliber carrier for said sub-caliber projectile and for obturating propellant gases during projectile launch, which includes;

a plurality of sabot ramp surfaces on an outer surface of said sabot assembly means, said plurality of sabot ramp surfaces being tapered to a rear of said sabot means;

(c) a centering band seat operatively disposed in said sabot means;

(d) a centering band positioned in said centering band seat having a tapered face to a rear of the sabot means, said tapered face of said centering band being an extension of one of said sabot ramp surfaces a centering band during extrusion prevents initial low pressure gases from escaping; and (e) a self-sealing obturator having an rearward extension for a mating case mouth cemented to the obturator to reduce movement of the obturator, and outer surface of the obturator conforming to chamber walls of the gun tube, and obturator ramp means in contact with said sabot ramp surfaces and said tapered face of said centering band for producing intimate contact between said outer surface of said obturator and said gun tube, said propellant gases forcing said obturator ramp means to slide on said sabot ramp surfaces and to continually feed material of the obturator between said gun tube and said centering band, and a retaining lip on said obturator ramp means to overlap a retaining surface on said plurality of sabot ramp surfaces on the sabot means which prevents said obturator from backing off during initial impact against bore walls of said gun tube.

2. A discarding sabot projectile assembly as recited in claim 1 wherein said extension of said obturator further comprises a "V" groove which permits separation of the extension with the case mouth during the initial low pressure which occurs early in ignition.

3. A discarding sabot projectile assembly as recited in claim 1 wherein said centering band comprises a stress notch in a forward face of said band for fascilitating said band to discard after leaving a muzzle.

4. A discarding sabot projectile assembly as recited in claim 1 which includes an opening disposed at a juncture of said obturator adjacent to the tapered face of the centering band, seal means operatively positioned in said opening for preventing propellant gases from entering between the obturator and the gun tube.

5. A sabot discard projectile assembly as recited in claim 1 wherein said sabot assembly means is covered with a sealing material cover.

* * * * *